US005302340A

United States Patent [19]

Takeda

[11] Patent Number: 5,302,340

[45] Date of Patent: Apr. 12, 1994

[54] METHOD OF FORMING CERAMIC LAYER ON METALLIC BODY

[75] Inventor: Shuichi Takeda, Kanagawa, Japan

[73] Assignee: Kabushiki Kaisha Komatsu Seisakusho, Tokyo, Japan

[21] Appl. No.: 879,135

[22] PCT Filed: Apr. 21, 1989

[86] PCT No.: PCT/JP89/00429

§ 371 Date: Dec. 19, 1989

§ 102(e) Date: Dec. 19, 1989

[87] PCT Pub. No.: WO89/10432

PCT Pub. Date: Nov. 2, 1989

Related U.S. Application Data

[63] Continuation of Ser. No. 764,978, Sep. 23, 1991, abandoned, which is a continuation of Ser. No. 457,791, Dec. 19, 1989, abandoned.

[30] Foreign Application Priority Data

Apr. 21, 1988 [JP] Japan ..... 63-98827

[51] Int. Cl.[5] ..... B22F 3/10; B22F 3/12; B22F 7/02

[52] U.S. Cl. ..... 419/45; 419/19; 419/48; 419/49; 427/189; 427/191; 427/193; 427/205; 427/226

[58] Field of Search ..... 419/8, 9, 19, 45, 48, 419/49; 427/189, 191, 193, 205, 226

[56] References Cited

U.S. PATENT DOCUMENTS 4,363,832 12/1982 Odawara ..... 427/183
4,655,830 4/1987 Akashi et al. ..... 75/233
4,761,262 8/1988 Ogata et al. ..... 419/10

FOREIGN PATENT DOCUMENTS 61-186404 8/1986 Japan .

OTHER PUBLICATIONS

Patent Abstracts of Japan, vol. 12, No. 109 (M-682), Apr. 8, 1988.
Patent Abstracts of Japan, vol. 12, No. 131 (M-688) Apr. 22, 1988.
Patent Abstracts of Japan, vol. 12, No. 326 (C-525), Sep. 5, 1988.
Patent Abstracts of Japan, vol. 9, No. 152 (M-391), Jun. 27, 1985.

*Primary Examiner*—Donald P. Walsh
*Assistant Examiner*—Daniel Jenkins
*Attorney, Agent, or Firm*—Armstrong, Westerman, Hattori, McLeland & Naughton

[57] ABSTRACT

A method of forming a ceramic layer, which is compact and rich in adhesion to a metallic body, on the metallic body without adding binders even though said ceramics is hard to be sintered ceramics such as various kinds of non oxide ceramics. Said method comprises a step of placing ceramic powders and/or a mixture of ceramic powders and metallic powders or a mixture of metallic powders and non metallic powders on the metallic body and a step of forming the ceramic layer on the metallic body in a moment by a reaction heat of the Thermit® reaction under the pressurized condition. In addition, a metallic insert member can be disposed between said metallic body and various kinds of powder placed on said metallic body. Furthermore, the resulting ceramic/metal composite member is subjected to a hot hydrostatic pressing or a hot pressing under high temperatures and high pressures.

8 Claims, 1 Drawing Sheet

METHOD OF FORMING CERAMIC LAYER ON METALLIC BODY

This application is a continuation of Ser. No. 07/764,978 filed on Sep. 23, 1991, now abandoned, which is a continuation of application Ser. No. 07/457,791 filed Dec. 19, 1989, now abandoned.

TECHNICAL FIELD OF THE INVENTION

This invention relates to a method of forming a compact ceramic layer on a metallic or a cermet body, and more particularly to a method of forming a compact ceramic layer having an enhanced bonding to the metallic or cermet bodies by utilizing a great deal of heat developed immediately by Thermit reaction which ignites conveniently under a pressurized condition.

BACKGROUND ART OF THE INVENTION

As to the conventional methods of forming a ceramic layer on the metallic or the cermet body, there are known CVD and PVD vapor deposition methods and plasma spray coating method, etc.

Further, a method for sintering a ceramic powder, a metal powder, or a mixture thereof, which utilizes the heat developed by Thermit reaction as the heat source, is disclosed in Japanese Laid-Open Patent Application No. SHO 61-186404 (which corresponds to U.S. Pat. No. 4,761,262). However, as far as the knowledge of the applicant of the present invention is concerned, no techniques have heretofore been developed, which provide the method of forming a sintered ceramic layer tightly bonded to a metallic or a cermet base material.

The above-mentioned CVD and PVD vapor deposition methods, etc. quoted as prior arts have so far involved problems or points at issue, in particular, on the bonding of coating on metals and cermets, and are unable to provide excellent characteristics of ceramic layers themselves such as resistance to abrasion, resistance to oxidation, and resistance to corrosion, etc.

OUTLINE OF THE INVENTION

The present invention has been made to solve the above-mentioned problems in the prior art, and has for its object to provide a method of forming a ceramic layer on the metallic or the cermet body, characterized by comprising the steps of placing a green ceramic compact layer forming material such as a ceramic powder, etc. on the metallic or cermet body, and immediately forming on the metallic or cermet body a compact ceramic layer having enhanced bonding properties to the metallic or cermet body under a pressurized condition with the heat developed by Thermit reaction.

To achieve the above-mentioned object, according to a first aspect of the present invention, there is provided a method of forming a ceramic layer on a metallic or cermet body, comprising the steps of placing green ceramic powders or a mixture of ceramic powders, non-metallic powders and metallic powders forming a ceramic layer, and a mixture of non-metallic element powders with metallic powders for forming a ceramic layer on the metallic or cermet body, and immediately forming on the metallic or comet body a compact ceramic layer having enhanced bonding properties to the metallic or cermet bodies under a pressurized condition with the heat developed by Thermit reaction.

To achieve the above-mentioned object, according to a second aspect of the present invention, there is provided a method of forming a ceramic layer on a metallic or cermet body as set forth in the above-mentioned first aspect, wherein in that, to start the reaction of a Thermit composition under a pressurized condition conveniently and effectively, either a Si-Thermit composition alone or a mixture of a Si-Thermit composition with another Thermit composition is used as the heat source for igniting the Thermit compositions.

To achieve the above-mentioned object, according to a third aspect of the present invention, there is provided a method of forming a ceramic layer on a metallic or a cermet body, comprising the steps of placing in layers a ceramic compact powder and a mixture of a metallic powder with a non-metallic element powder or a green compact mixture of a ceramic powder with a metallic powder on the metallic or cermet body, and immediately forming on the metallic or cermet body a compact ceramic layer having enhanced bonding properties to the metallic or cermet body under a pressurized condition with the heat developed by Thermit reaction.

To achieve the above-mentioned object, according to a fourth aspect of the present invention, there is provided a method of forming a ceramic layer on a metallic or cermet body, comprising the steps of placing either a green compact mixture of a metallic powder with a non-metallic element powder, or a green compact mixture of a metallic compound powder with a non-metallic compound powder on the metallic or cermet body, and immediately forming a ceramic layer on the metallic body under a pressurized condition with the heat developed by Thermit reaction.

To achieve the above-mentioned object, according to a fifth aspect of the present invention, there is provided a method of forming a ceramic layer on a metallic cermet body, comprising the steps of placing either at least one kind of metal selected from among the group consisting of Ib, IIb, IVa, Vb, VIb, VIIb and VIII groups according to the periodic table, and an alloy of these metals, as an insert material, on the metallic or cermet body, placing further a ceramic green compact powder or a green compact mixture of a ceramic powder with a metallic powder on the metallic or cermet body, and then forming a ceramic layer on the metallic or cermet body under a pressurized condition with the heat developed by Thermit reaction.

Since the method of forming a ceramic layer on a metallic or cermet body according to the present invention is a process which utilizes the sudden generation of heat by Thermit reaction and the exothermic reaction of a ceramic products which is induced effectively and efficiently by the Thermit reaction, various kinds of non oxide ceramics, which were difficult to sinter and which could provide a compact ceramic layer only by using a binder, can be used to form a compact ceramic layer without having to use a binder, and also they can provide an enhanced bonding to a metallic or cermet body.

Further, the method of the present invention provides another advantage in that since the heating time is very short the ceramic grain growth can be restrained markedly as well as reducing thermal damage of the metallic or cermet body. Further, in addition to the characteristic feature of the method of forming a ceramic layer using Thermit reaction, the resistance to corrosion,.resistance to heat and resistance to abrasion of the ceramic layer can be improved markedly by limiting the content of oxygen which is an impurity existent unavoidably in powdery raw materials to a particular range and by limiting the particle diameter of the powdery raw material in the same way so that various kinds of very excellent ceramic layers can be provided.

Thus, the method of the present invention can be widely used to form excellent lens forming molds, provision of which has come to be required with the recent improvement in the performance of glass lenses, various kinds of materials for chemical industry for use in severe environmental conditions, and various kinds of mechanical parts which require high resistance to abrasion, and can therefore contribute to industrial development.

The above-mentioned and other objects, aspects and advantages of the present invention will become apparent to those skilled in the art by making reference to the following description and the accompanying drawings in which a preferred embodiment incorporating the principles of the present invention is shown by way of example only.

DETAILED DESCRIPTION OF THE INVENTION

Figure 1:
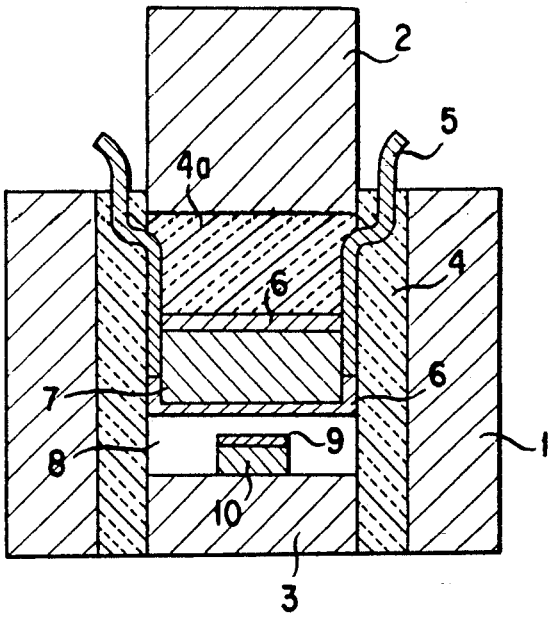
FIG. 1 is a sectional view showing one embodiment of the pressing apparatus adapted for use in the method of the present invention.

The present invention will now be described in detail below by way of example only with reference to the accompanying drawing.

FIG. 1 shows a manufacturing apparatus which is used to form a ceramic layer on a metallic or the cermet body according to the present invention. In the drawing, reference numeral 1 denotes a cylinder, 2 a pressing punch, 3 a platform made of a metal or ceramic 4 a cylinder made of a ceramic, 4a a plate, 5 an electric wire made of a ceramic, 6 a Si-Thermit composition, 7 an Al-Thermit composition, 8 a hexagonal boron nitride molded article, 9 a ceramic green compact powder or a green compact mixture of a metallic powder with a ceramic power for providing a compact ceramic layer, and 10 a metallic or cermet body for forming a ceramic layer thereon.

Out of the above-mentioned component parts, the cylinder 1, the pressing punch 2 and the metal platform 3 form a pressure generating vessel, whilst the ceramic cylinder 4 serves as a thermal insulation material and a pressure seal.

The electric wire 5 made of a ceramic constitutes an internal heater to ignite the Si-Thermit composition 6 to thereby ignite the Al-Thermit composition 7 with a chain-reaction.

The hexagonal system boron nitride molded article 8 functions to prevent reaction from occurring between the ceramic layer 9 to be formed on the metallic or cermet body and the Thermit compositions 6 and 7 and serves to achieve excellent condition of the heat generated by Thermit reaction.

The operation of the above-mentioned pressing apparatus will be described below.

The metallic or cermet body 10 on which a green compact ceramic powder or a green compact mixture 9 of a ceramic powder with a metallic powder is placed on the metal platform 3 forming the bottom wall of the cylinder 1. Further, the hexagonal system boron nitride molded article 8 is placed on the ceramic powder or the mixture, and then the Al-Thermit composition 7 around which the Si-Thermit composition 6 is placed is disposed on the molded article 8. Further, the ceramic plate 4 is placed on the Si-Thermit composition. Thereafter, a load is applied by means of the pressing punch 2 so as to apply more than 500 atmospheres of pressure onto the ceramic green compact powder or green compact mixture 9 of a ceramic powder with a metal powder.

By turning on electricity to the ceramic electric wire 5 under the above-mentioned pressurized condition, the Si-Thermit composition 6 disposed around the Al-Thermit composition 7 is ignited thereby causing the ignition of the Al-Thermit composition with a chain-reaction thus generating a great deal of heat by the Thermit reaction.

The time series chemical reaction commencement of the Thermit compositions is represented by the following formula.

$$Si+2/3Fe_2O_3 \rightarrow SiO_2+4/3Fe+86\ Kcal$$

$$2Al+Fe_2O_3 \rightarrow Al_2O_3+2Fe+204\ Kcal$$

A fine ceramic layer is formed on the metallic or cermet body by the heat developed by the ignition of the Thermit composition. After that, the loading is released, and the sample is recovered.

EXAMPLE 1

0.02 g of $TiB_2$ powder having an oxygen content of 0.6% and a mean particle diameter of 1.0 μm to be used as the ceramic green compact powder 9 was placed on a 4.0% Co-WC disc having a diameter of 6.0 mm and a thickness of 2.5 mm. Whilst, as to the Thermit composition, 42 gr of a Thermit composition prepared by mixing Al powder and $Fe_2O_3$ powder at a molar ratio of 2:1 was cold molded on a disc having a diameter of 30 mm. At the same time, 6 gr of a Si-Thermit composition was placed in the above-mentioned manufacturing apparatus to form a compact ceramic layer.

The amount of heat generated by Thermit reaction in this example was 43.8 Kcal.

It was possible to scratch the 4.0% Co-WC hard metal by means of a ceramic edge composed solely of the $TiB_2$ prepared in this example, which exhibited that a compact ceramic layer was obtained.

When the ceramic layer obtained in this example was subjected to grinding by means of a diamond grinding wheel, the ground surface had silver luster.

Even when the $TiB_2$/WC-4% Co pellets obtained in this example were subjected repeatedly to heating and cooling treatments in atmosphere and at a temperature of 700° C., peeling of the ceramic layer from the cermet body did not occur, and so it was confirmed that the $TiB_2$ ceramic layer had an extremely excellent compactness to the WC-4% Co pellet.

To investigate the bonding interface of the $TiB_2$/WC-4% Co pellet in detail, the hard cermet pellet obtained in this example was cut by means of a diamond cutter, and then ground. As a result of observation of the cut portion by SEM, it was revealed that the bonding interface between the ceramic layer and the WC-4% Co disc exhibited an extremely excellent bonding properties.

As to the metallic or cermet body on which a ceramic layer is to be formed, tests were performed using samples made of high speed steel, stainless steel and cast iron, etc., respectively. As a result, it was found out that they provided a extremely excellent compact ceramic layer and extremely excellent bonding property to the metallic body and the hard metal body, as in the case of the above-mentioned 4% Co-WC cermet.

EXAMPLE 2

A ceramic layer (stating exactly, cermet layer) was formed under the same conditions as in EXAMPLE 1, except that 0.1 gr of a mixture of $TiB_2$ and Ni (percent of Ni by volume: 3%) was used as the ceramic powder and metal green compact powder 9 used in EXAMPLE 1, the oxygen contents of $TiB_2$ and Ni were set at 0.6% and 0.4%, respectively, and the mean particle diameters of $TiB_2$ and Ni were set at 1.0 μm and 3.0 μm, the heat value by Thermit reaction was set at 35 KCAL, and carbon steel was used as the material of the metallic body 10.

As a result of observation by SEM on the pellet after cutting and grinding thereof, it revealed that the ceramic layer obtained in this example exhibited extremely excellent compactness and bonding property to the carbon steel, and extremely uniform distribution of Ni, and that an extremely thin Ni layer was bonded $TiB_2$ particles.

It was possible to scratch carbon steel easily by means of cermet layer edge.

EXAMPLE 3

A ceramic layer was formed under the same conditions as in EXAMPLE 1, except that 0.02–0.04 gr of each of TiC (oxygen content: 0.5%, mean particle diameter: 1.2 μm), TiN (oxygen content: 0.7%, mean particle diameter: 1.0 μm), and $TiC_{0.5}N_{0.5}$ (oxygen content: 0.8%, mean particle diameter: 1.3 μm) were used as the ceramic green compact powder 9 in EXAMPLE 1, the heat value by Thermit reaction was set at 40 KCAL, and stainless steel was used as the material of the metallic body.

The ceramic layer obtained in this example exhibited extremely excellent performance as in the case of EXAMPLE 1.

EXAMPLE 4

A ceramic layer was formed under the same conditions as in EXAMPLE 1, except that, as the ceramic green compact powder 9, 0.01 gr of $B_4C$ (oxygen content: 0.8%, mean particle diameter: 2 μm) was placed on a 4% Co-WC disc, and further 0.2 gr of a green compact mixture of Ti powder and B powder in a molar ratio of 1:2 was placed in layer $B_4C$, and the heat value by Thermit reaction was set at 35 KCAL.

The ceramic layer resulted from the mixture of $TiB_2$, $B_4C$ and TiC in this example provided an extremely compact hard layer having an excellent bonding to the metallic body 10.

Further, in this example, by placing a green compact mixture of Ti/C in a molar ratio of 1:1 or a mixture green compact of $TiO_2$, C and Al in a molar ratio of 3:3:4, as a substitute to Ti/B mixture which was placed just above the $B_4C$ green compact powder 9 in the previous case, through a hexagonal boron nitride layer on the $B_4C$ green compact powder, and by keeping the heat value by Thermit reaction at the same value as in the previous case, a compact $B_4C$ ceramic layer was formed on the 4% Co-WC disc, which layer exhibited excellent bonding properties to the metallic body 10.

EXAMPLE 5

A ceramic layer was formed under the same conditions as in EXAMPLE 1, except that 0.03 gr of a green compact mixture of Ti powder (mean particle diameter: 5 μm, oxygen content: 0.5%) and B powder (mean particle diameter: 0.5 μm, oxygen content: 0.8%) in a molar ratio of 1:2, and 0.02 gr of a green compact mixture of Si powder (mean particle diameter: 2 μm, oxygen content: 0.6%) and C powder (mean particle diameter: 3 μm, oxygen content: 0.5%) in a molar of 1:1 were placed in layer on a stainless steel disc, in place of the ceramic green compact powder 9, and the heat value by Thermit reaction was set at 30 KCAL.

In both cases of Ti/B powder mixture and Si/C powder mixture, as a result of X-ray diffraction, only single phase of ceramics of $TiB_2$ and SiC, respectively, were detected on the stainless steel disc.

However, in view of the increase in the oxygen content of Si/C powder mixture, it is preferable to keep the ratio of Si/C less than 1.

EXAMPLE 6

A ceramic layer was formed under the same conditions as in the case of EXAMPLE 1, except that, in place of the ceramic green compact powder 9, 0.06 gr of a green compact mixture of $B_4C$ powder (whose oxygen content and mean particle diameter were the same as those in EXAMPLE 4) and Ti powder (whose oxygen content and mean particle diameter were the same as those in EXAMPLE 5) in a molar ratio of 4:1 was placed on a 4% Co-WC cermet disc, and the heat value by Thermit reaction was set at 35 KCAL.

The resultant ceramic layer was comprised of $B_4C$, $TiB_2$ and TiC and exhibited a satisfactory compactness and excellent bonding properties to the metallic body.

EXAMPLE 7

A ceramic layer was formed under the same conditions as in the case of EXAMPLE 1, except that a thin Ta plate, 0.05 mm thick, was previously placed on the metallic body 10, 0.02 gr of ZrN powder green compact (mean particle diameter: 1 μm, oxygen content: 1%) was placed, as the ceramic green compact powder, on the thin plate, and the heat value by Thermit reaction was set at 35 KCAL. The Ta thin plate used in this example was effective for relaxing the thermal stress on the ceramic layer and the cermet body and forming an extremely excellent crack-free ceramic layer.

The same satisfactory effect was obtained in case a thin plate of Mo, Ti-Cr alloy, Ta-Zr alloy or Cu-Ti alloy, etc. was used in place of the Ta thin plate used in this example, or in case those green compact powders discussed above were placed in place of the above-mentioned Ta thin plate.

EXAMPLE 8

A ceramic layer was formed under the same conditions as in the case of EXAMPLE 1, except that a mixture of $TiB_2$ and $Ni_4B_3$ (in a volume ratio of 6:4) was used as the ceramic green compact powder 9 in EXAMPLE 1, a Ni-Ti thin plate, 0.05 mm thick, was previously placed on the cermet body, and the heat value by Thermit reaction was set at 30 KAL.

The cermet (WC-Co) composite body obtained by this ceramic layer forming method was subjected to HIP (hot hydrostatic pressure pressing) treatment in an Argon atmosphere kept at a temperature of 600° C. and a 1,000 atmospheres of pressure, for 30 minutes.

As a result of thermal shock tests on the resultant $TiB_2$ ceramic composite layer on the cermet body by repeatedly immersing the ceramic layer kept at 600° C. into water, it revealed that the ceramic composite layer maintained more stable bonding properties to the cermet body than that in case it was not subjected to HIP treatment. HIP and HP (hot pressing) treatments are indispensable, in particular, for ceramic/metal or cermet/cermet composite materials for use under severe thermal conditions. Further, the above-mentioned ceramic layer was subjected to HP treatment (700° C., 200 atmospheres of pressure), as a similar treatment, and as a result, a similar improvement in the resistance to thermal shock was achieved.

No difference in the result can be recognized between those subjected to HP and HIP treatments, respectively, and those which were not subjected to such treatments, at a temperature of 500° C. and at a pressure of 200 atmospheres or under. Further, at a temperature of 1,200° C. or above, significant changes occur in the shape and structure of the and the cermet body, whilst pressing treatments by using a pressure of more than 2,000 atmospheres involve increases in cost, and little industrial effect can be expected.

It is of course possible to select any one of $N_2$, $H_2$, Ar (or $O_2$ in a special case), or a mixture of them, as the atmosphere in which HIP or HP treatment is to be made, depending on the purpose of use.

COMPARATIVE EXAMPLE 1

Examples of the effect of oxygen, which is an unavoidably existent impurity, on the compactness of the ceramic layer and on the bonding properties thereof to the or the cermet body, and examples of the effect of particle diameter of metallic powder ceramic powder and non-metallic element powder on the characteristics of the ceramic layer are shown in EXAMPLES 1 to 7.

To make these results more clearly, a ceramic layer was formed using $TiB_2$ powder having an oxygen content of 1.8%, according to a similar procedure to that in EXAMPLE 1. The resultant ceramic layer was less compact than that in the case of using the powder with a low oxygen content in EXAMPLE 1 and exhibited an inferior bonding to the 4% Co-WC cermet disc.

Further, the grain size of the ceramic of $TiB_2$ forming the ceramic layer grew partially abnormally, and in a heating and cooling cycle at a temperature ranging from a room temperature in the atmosphere to 700° C., a portion of the ceramic layer broke down.

Regarding the other examples 2 to 6, oxygen, which is an unavoidably existent impurity, lowered the compactness of the ceramic layer and the bonding properties to the or the cermet body.

COMPARATIVE EXAMPLE 2

To clarify the effect of the particle diameter of each of powdery raw materials forming the ceramic layer, a ceramic layer was formed using TiC powder having a mean particle diameter of 15 μm, according to a similar procedure to that in EXAMPLE 3. The compactness of the resultant ceramic layer deteriorated, and in most cases molten metal from the substrate metallic body intruded into the ceramic layer. Similar troubles occurred in EXAMPLE 1 to 6. Further, in particular, in cases of ceramics having strong thermal anisotropy in the crystal structure thereof, a great many intergranular cracks occur with increasing in the crystalline particle diameter thus increasing the frequency of occurrence of break-down. In addition thereto, the ceramic product layer resulted from a starting material such metallic elements/non-metallic elements as shown in EXAMPLE 5 will contain non-reacted metallic elements and non-metallic elements. It is necessary to keep the mean particle diameter of powdery raw materials 10 μm or under.

What is claimed is:

1. A method of forming a ceramic or cermet layer on a metallic or cermet body, comprising the steps of placing a ceramic green compact powder or a green compact mixture of a ceramic powder with a metallic powder on the metallic or cermet body, applying pressure to the green compact powder or mixture, heating the green compact powder or mixture by heat generated by a thermitic reaction, thus forming on said metallic or cermet body a bonded compact ceramic or cermet layer.

2. A method of forming a ceramic or cermet layer on a metallic or cermet body as claimed in claim 1, wherein to start the reaction of a thermit composition under a pressurized condition conveniently and effectively, either a Si-thermit composition alone or a mixture of a Si-thermit composition with another thermit composition is used as the heat source for igniting the thermit compositions.

3. A method of forming a ceramic or cermet layer on a metallic or cermet body, comprising the steps of placing in layers a ceramic green compact powder and a green compact mixture of a metallic powder with a non-metallic powder or a green compact mixture of a ceramic powder with a metallic powder on said metallic or cermet body, applying pressure to the green compact powder and mixture, heating the green compact powder and mixture by heat generated by a thermitic reaction thus forming on said metallic or cermet body a bonded compact ceramic or cermet layer.

4. A method of forming a ceramic or cermet layer on a metallic or cermet body, comprising the steps of placing either one of a green compact mixture of a metallic powder with non-metallic powder or a green compact mixture of a metallic compound powder with a non-metallic compound powder on the metallic or cermet body, applying pressure to the green compact mixture, heating the green compact mixture by heat generated by a thermitic reaction, thus forming on said metallic or cermet body a bonded compact ceramic or cermet layer.

5. A method of forming a ceramic or cermet layer on a metallic or cermet body as claimed in claim 1, comprising the steps of placing at least one kind of metal selected from the group consisting of Ib, IIb, IVb, Vb, VIb, VIIb and VIII groups according to the periodic table, and an alloy of these metals, as an insert material, between said metallic or cermet body and each of said green compact powders placed on the metallic or cermet body.

6. A method of forming a ceramic or cermet layer on a metallic or cermet body as claimed in claim 3, comprising the steps of placing at least one kind of metal selected from the group consisting of Ib, IIb, IVb, Vb, VIb, VIIb and VIII groups according to the periodic table, and an alloy of these metals as an insert material, between said metallic or cermet body and each of said green compact powders placed on the metallic or cermet body.

7. A method of forming a ceramic or cermet layer on a metallic or cermet body as claimed in claim 4, comprising the steps of placing at least one kind of metal selected from the group consisting of Ib, IIb, IVb, Vb, VIb, VIIb and VIIIb and VIII groups according to the periodic table, and an alloy of these metals as an insert material between said metallic or cermet body and each of said green compact powders placed on the metallic or cermet body.

8. A method of forming a ceramic or cermet layer on a metallic or cermet body as claimed in any one of claims 1, 3, 4 to 7, wherein a resultant cermet/metal, ceramic/metal, ceramic/cermet or cermet/cermet composite member is subjected to hot hydrostatic pressure pressing treatment or hot pressing treatment at a temperature ranging from 500° to 1,200° C. and at a pressure ranging from 200 to 2,000 atmospheres.

* * * * *